US009852860B2

(12) United States Patent
Hsiao

(10) Patent No.: US 9,852,860 B2
(45) Date of Patent: Dec. 26, 2017

(54) PARAMETER SETTING CIRCUIT OF A POWER CONVERSION APPARATUS AND A METHOD FOR GENERATING A CURRENT

(71) Applicant: uPI Semiconductor Corp., Hsinchu County (TW)

(72) Inventor: Chih-Wen Hsiao, Hsinchu County (TW)

(73) Assignee: uPI Semiconductor Corp., Hsinchu County (TW)

( * ) Notice: Subject to any disclaimer, the term of this patent is extended or adjusted under 35 U.S.C. 154(b) by 184 days.

(21) Appl. No.: 15/059,306

(22) Filed: Mar. 3, 2016

(65) Prior Publication Data

US 2017/0133182 A1 May 11, 2017

(30) Foreign Application Priority Data

Nov. 9, 2015 (TW) ..... 104136786 A

(51) Int. Cl.
*H01H 47/00* (2006.01)

(52) U.S. Cl.
CPC ..... *H01H 47/00* (2013.01)

(58) Field of Classification Search
CPC ..... H01H 47/00; G05F 1/10
See application file for complete search history.

(56) References Cited

U.S. PATENT DOCUMENTS

| | | | | |
|---|---|---|---|---|
| 6,286,127 | B1 | 9/2001 | King et al. | |
| 6,624,710 | B2 | 9/2003 | Tian | |
| 6,882,133 | B2 | 4/2005 | Haraguchi et al. | |
| 7,855,903 | B2 | 12/2010 | Khayat et al. | |
| 7,936,160 | B1 * | 5/2011 | Sheehan | H02M 3/156 323/222 |
| 8,269,564 | B2 | 9/2012 | Lu et al. | |
| 2010/0301827 | A1 * | 12/2010 | Chen | H02M 3/156 323/299 |
| 2012/0025792 | A1 * | 2/2012 | Lipcsei | H02M 1/08 323/271 |
| 2014/0266118 | A1 * | 9/2014 | Chern | H02M 3/156 323/283 |

* cited by examiner

*Primary Examiner* — Jeffrey Shin
(74) *Attorney, Agent, or Firm* — JCIPRNET

(57) ABSTRACT

A method for generating a current adapted to a parameter setting circuit is provided. The parameter setting circuit is coupled to an external setting impedor. The external setting impedor is coupled to an external voltage and outputs a first current. The method for generating the current includes the following steps. A reference voltage and an end voltage of a reference resistor are compared to get a comparison result. The end voltage is adjusted according to a comparison result. A setting parameter is obtained according to the adjusted end voltage. A setting current is generated according to a compensation current. The compensation current is related to a first current and the setting parameter. In addition, a parameter setting circuit of a power conversion apparatus is also provided.

21 Claims, 7 Drawing Sheets

PARAMETER SETTING CIRCUIT OF A POWER CONVERSION APPARATUS AND A METHOD FOR GENERATING A CURRENT

CROSS-REFERENCE TO RELATED APPLICATION

This application claims the priority benefit of Taiwan application serial no. 104136786, filed on Nov. 9, 2015. The entirety of the above-mentioned patent application is hereby incorporated by reference herein and made a part of this specification.

BACKGROUND OF THE INVENTION

1. Field of the Invention

The invention relates to a parameter setting circuit and a method for generating a current, and particularly relates to a parameter setting circuit and a method for generating a current for a power conversion apparatus.

2. Description of Related Art

Generally speaking, an electronic circuit usually requires a parameter setting circuit to generate a current that is set based on the practical design requirement. Such parameter setting circuit normally sets a current by coupling a resistor to a specific voltage or a ground voltage. Conventionally, an internal resistor of the parameter setting circuit is serially coupled to an external setting impedor externally connected with the parameter setting circuit, and the resistor string is used to divide a specific voltage to generate a setting current. However, a current value of the setting current generated based on above may be deviated since the resistance value of the internal resistor cannot be determined accurately.

In the conventional art, different pins are provided in the parameter setting circuit to be respectively coupled to the specific voltage and the external setting impedor and used with different circuit structure designs to generate the setting current, so as to solve this issue. However, the manufacturing cost of the circuit may thus be increased.

SUMMARY OF THE INVENTION

The invention provides a parameter setting circuit for a power conversion apparatus. The parameter setting circuit is configured to provide the power conversion apparatus with a setting parameter.

The invention provides a method for generating a current capable of accurately generating a setting current.

A parameter setting circuit according to an embodiment of the invention is coupled to an external setting impedor. The parameter setting circuit includes a switch unit 440, an internal parameter adjustment unit, and a setting unit. The switch unit is coupled to the external setting impedor. The internal parameter adjustment unit is coupled to the switch unit. The internal parameter adjustment unit includes a setting reference unit. The setting reference unit is coupled to the external setting impedor through the switch unit. The internal parameter adjustment unit provides an adjustment parameter through an operation of the switch unit based on a predetermined parameter ratio, the external setting impedor, and the setting reference unit. The setting unit is coupled to the switch unit. The setting unit generates a setting current based on the operation of the switch unit. The setting current is a combination of an adjustment current and an initial setting current. Generation of the adjustment current is related to the adjustment parameter.

According to an embodiment of the invention, the internal parameter adjustment unit further includes a voltage dividing circuit. The voltage dividing circuit presents the predetermined parameter ratio by using a reference voltage that is provided. Also, the internal parameter adjustment unit also includes a comparator. An input end of the comparator s coupled to the voltage dividing circuit and a first end of the setting reference unit, and the comparator outputs a comparison result. The comparator adjusts an end voltage of the first end based on the comparison result.

According to an embodiment of the invention, a control signal periodically controls the switch unit. The comparator periodically compares and adjusts the end voltage based on the comparison result.

According to an embodiment of the invention, the setting reference unit is a variable resistor. The comparator controls a resistance value of the variable resistor based on the comparison result to change the end voltage.

According to an embodiment of the invention, when the end voltage is equal to the reference voltage, a ratio between the external setting impedor and the variable resistor is equal to the predetermined parameter ratio.

According to another embodiment of the invention, the internal parameter adjustment unit further includes a variable current source. The variable current source provides a variable current, and is coupled to the setting reference unit to adjust the variable current based on the comparison result, so as to change the end voltage.

According to another embodiment of the invention, the compensation current is changed based on a current value of the variable current.

According to another embodiment of the invention, the external setting impedor is coupled to a first voltage to output a first current. The current generating circuit further includes a current mirror circuit. The current mirror circuit includes a first end and a second end. The first end is coupled to the compensation current source and the external setting impedor. The current mirror circuit is configured to mirror the compensation current and the first current from the first end to the second end, so as to generate the setting current.

A parameter setting circuit for a power conversion apparatus according to an embodiment of the invention is coupled to a first end of an external setting impedor. A second end of the external setting impedor is coupled to a first voltage. The parameter setting circuit includes a switch unit 440, an internal parameter adjustment unit, and a setting unit. The switch unit is coupled to the external setting impedor. The internal parameter adjustment unit has a predetermined parameter ratio and a setting reference unit. The setting reference unit is coupled to the switch unit. The internal parameter adjustment unit adjusts the setting reference unit based on an operation of the switch unit, the external setting impedor, the setting reference unit, the first voltage, and the predetermined parameter ratio, and provides a setting parameter based on the adjusted setting reference unit. The setting unit is coupled to the switch unit and generates a setting current based on the first voltage, the external setting impedor, and the setting parameter.

According to an embodiment of the invention, the setting reference unit is coupled to the external setting impedor through the switch unit. A control signal periodically controls the switch unit to compare and adjust the setting reference unit.

According to another embodiment of the invention, the internal parameter adjustment unit includes a voltage dividing circuit. The voltage dividing circuit provides a reference voltage to present the predetermined parameter ratio, and the setting reference unit is a variable resistor having a first end. The first end has an end voltage. The internal parameter adjustment unit includes a comparator configured to compare the reference voltage and the end voltage, output a comparison result, and adjusts the variable resistor based on the comparison result.

According to an embodiment of the invention, when a ratio between the external setting impedor and the variable resistor is equal to the predetermined parameter ratio, the internal parameter adjustment unit provides the setting parameter based on the adjusted variable resistance.

According to another embodiment of the invention, the setting unit includes a compensation current source. The compensation current source provides compensation current based on the setting parameter.

According to another embodiment of the invention, the internal parameter adjustment unit includes a setting reference unit and a first current generating circuit. The first current generating circuit generates a first current based on the operation of the switch unit, the external setting impedor, the setting reference unit, and the first voltage.

According to another embodiment of the invention, the setting reference unit includes a second current generating circuit and a comparator. The second current generating circuit is coupled to the comparator, and the comparator adjusts a compensation current source by using the first current, so as to provide the setting parameter.

According to another embodiment of the invention, the external setting impedor provides a first current. The setting unit includes a current mirror circuit. The current mirror circuit includes a first end and a second end. The first end is coupled to the compensation current source and the external setting impedor. The current mirror circuit is configured to mirror the compensation current and the first current from the first end to the second end, so as to generate the setting current.

A method for generating a current according to an embodiment of the invention is adapted for a parameter setting circuit coupled to an external setting impedor. The external setting impedor is coupled to an external voltage to output a first current. The method for generating the current includes: comparing a reference voltage and an end voltage of an end of a reference resistor to obtain a comparison result; adjusting the end voltage based on the comparison result; obtaining a setting parameter based on the adjusted end voltage; and generating a setting current based on compensation current. The compensation current is generated based on a first current and the setting parameter.

According to an embodiment of the invention, in the step of comparing the reference voltage and the end voltage of the end of the reference resistor, the reference voltage and the end voltage are compared periodically based on a control signal.

According to an embodiment of the invention, the step of adjusting the end voltage based on the comparison result includes changing the end voltage by adjusting a resistance value of the reference resistor, such that the reference voltage and the end voltage are substantially equal.

According to an embodiment of the invention, the step of adjusting the end voltage based on the comparison result includes changing the end voltage by adjusting a current value of a variable current coupled to the reference resistor, such that the reference voltage and the end voltage are substantially equal.

According to an embodiment of the invention, the step of generating the setting current based on the compensation current includes: mirroring the compensation current and the first current from a first end of a current mirror circuit to a second end of the current mirror circuit, so as to generate the setting current. A current value of the compensation current is determined based on a current value of a second current. The current value of the second current is determined by the setting parameter.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
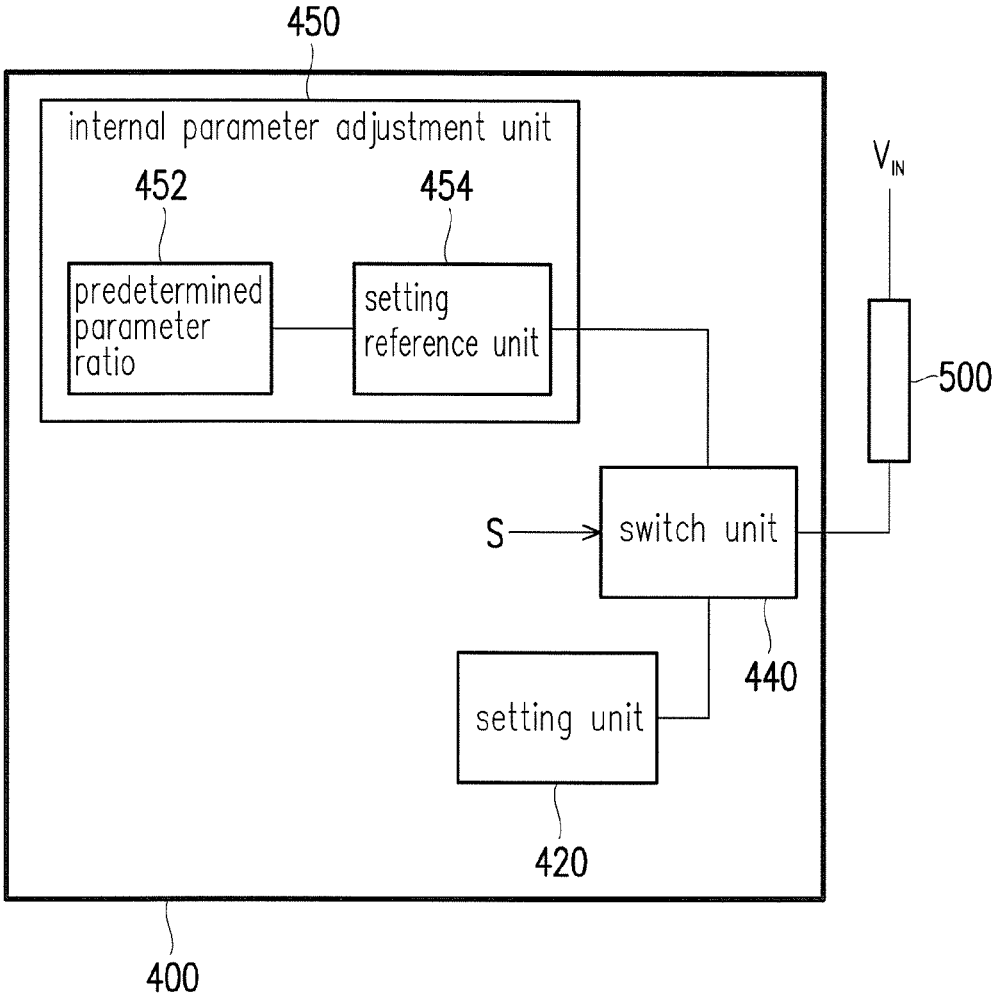
FIG. 1A is a block view illustrating a parameter setting circuit of the invention.

Reference will now be made in detail to the present preferred embodiments of the invention, examples of which are illustrated in the accompanying drawings. Wherever possible, the same reference numbers are used in the drawings and the description to refer to the same or like parts.

Several embodiments are provided below to describe the invention. However, the invention is not limited to the embodiments described herein. Also, the embodiments can be properly combined. Throughout the specification (including claims) of the invention, the term "couple" may refer to any direct or indirect connection means. For example, if it is described that a first device is coupled to a second device, it shall be interpreted that the first device may be directly connected to the second device or indirectly connected to the second device through another device or through a connection means. Moreover, the terra "resistor" may refer to at least one resistor, a resistance network, a capacitor, an inductor, or any element that provides a resistance value.

FIG. 1A is a block view illustrating a parameter setting circuit of the invention. Referring to FIG. 1, a parameter setting circuit 400 of the invention is a parameter setting circuit of a power conversion apparatus, for example. The parameter setting circuit 400 includes a switch unit 440, an internal parameter adjustment unit 450, and a setting unit 420. The parameter setting circuit 400 is coupled to a first end of an external setting impedor 500. A second end of the external setting impedor 500 is coupled to the first voltage $V_{IN}$. The switch unit 440 is coupled to the external setting impedor 500. In the present embodiment, the external setting impedor 500 is an element having an electrical impedance, and the electrical impedance is the measure of the opposition that a circuit presents to a current when a voltage is applied. The setting unit 420 is coupled to the switch unit 440. The internal parameter adjustment unit 450 has a predetermined parameter ratio 452 and a setting reference unit 454. The setting reference unit 454 is coupled to the switch unit 440. Also, the reference setting circuit 400 is coupled to the external setting impedor through the switch unit 440. The predetermined parameter ratio 452 is a resistance ratio, a current ratio, or a voltage ratio, for example. However, the invention does not intend to impose a limitation in this regard.

Specifically, the internal parameter adjustment unit 450 adjusts the setting reference unit 454 according to the operation of the switch unit 440, the external setting impedor 500, the setting reference unit 454, the first voltage $V_{IN}$, and the predetermined parameter ratio 452. The internal parameter adjustment unit 450 provides a setting parameter based on the adjusted setting reference unit 454. In this embodiment, a control signal S periodically controls the switch unit 440 to adjust the setting reference unit 454.

Figure 1B:
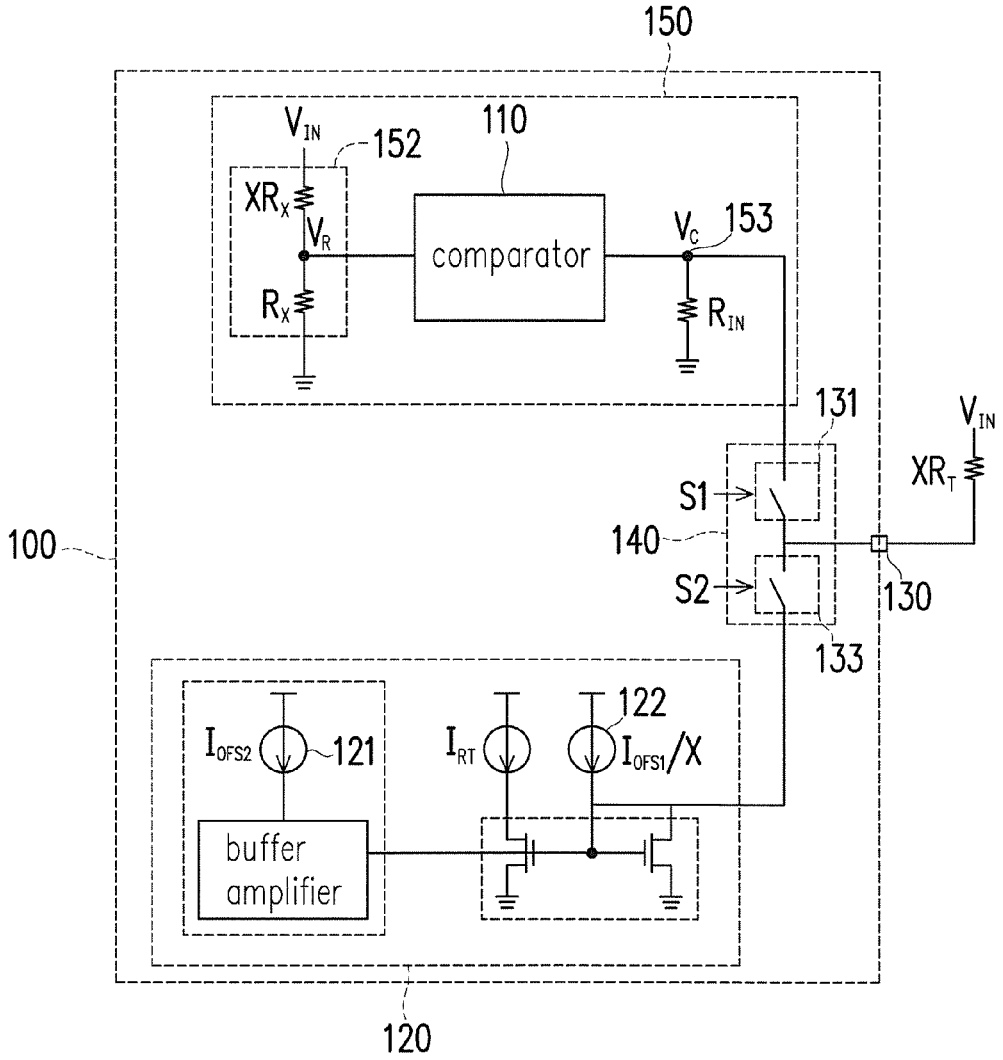
FIG. 1B is a schematic view illustrating the parameter setting circuit of the invention.

FIG. 1B is a schematic view illustrating the parameter setting circuit according to an embodiment of the invention. Referring to FIG. 1B, a reference setting circuit 100 includes a switch unit 140, an internal parameter adjustment unit 150, and a setting unit 120. The switch unit 140 is coupled to the external setting impedor $XR_T$. The internal parameter adjustment unit 150 is coupled to the switch unit 140. The setting unit 120 is coupled to the switch unit 140. For example, the reference setting circuit 100 may be coupled to the first voltage $V_{IN}$ through a pin 130 and an external setting impedor $XR_T$. X here is a predetermined parameter ratio based on the practical design requirement. However, the invention does not intend to impose a limitation in this regard. The predetermined parameter ratio X is a predetermined resistance ratio, for example.

Specifically, in this embodiment, the switch unit 140 includes switches 131 and 133 respectively controlled by control signals S1 and S2. The control signals S1 and S2 are in inverted phases. In this embodiment, the control signal S2 is obtained by inverting the control signal S1, for example. However, the invention does not intend to impose a limitation in this regard. In this embodiment, the internal parameter adjustment unit 150 includes a voltage dividing circuit 152, a setting reference unit $R_{IN}$, and a comparator 110. The voltage dividing circuit 152 provides a reference voltage $V_R$. The setting reference unit $R_{IN}$ has an adjustable end voltage $V_c$. An input end of the comparator is coupled to the voltage dividing circuit 152 and the setting reference unit $R_{IN}$. The comparator 110 is configured to compare the reference voltage $V_R$ and the end voltage $V_c$ and output a comparison result. The comparator 110 adjusts the end voltage $V_c$ based on the comparison result. In this embodiment, the setting reference unit $R_{IN}$ may be a resistor or a resistance network formed of a plurality of resistors. The invention does not intend to impose a limitation on the configuration of the setting reference unit $R_{IN}$.

In this embodiment, when the switch 131 is turned on, the switch 133 is not turned on. Here, the comparator 110 is configured to compare the reference voltage $V_R$ of an internal resistor $R_X$ and the end voltage $V_c$ of the setting reference unit $R_{IN}$ (referred to as reference resistor $R_{IN}$ in the following) of the parameter setting circuit 100, and the resistance value of the reference resistor $R_{IN}$ is adjusted based on a comparison result. Alternatively, in an embodiment, the comparator 110 may also adjust the current value of a variable current provided by a variable current source (not shown in FIG. 1B) of the internal parameter adjustment unit 150 based on the comparison result. The invention does not intend to impose a limitation in this regard. Then, in this embodiment, the setting unit 120 includes compensation current sources 121 and 122 respectively providing compensation currents $I_{OFS1}/X$ and $I_{OFS2}$. The current value of the compensation current $I_{OFS1}/X$ is determined by the current value of the compensation current $I_{OFS2}$, for example. Here, X may be a predetermined parameter ratio based on the practical design requirement. The invention does not intend to impose a limitation in this regard. In this embodiment, when the switch 131 is not turned on, the switch 133 is turned on. At this time, the setting unit 120 generates a setting current $I_{RT}$ based on the compensation current $I_{OFS1}/X$ and a current flowing through the external setting impedor $XR_T$, for example.

Thus, in this embodiment, the operation of the reference setting circuit 100 may be substantially divided into two stages. In the first stage, the switch 131 is turned on, and the switch 133 is not turned on. The comparator 110 compares the reference voltage $V_R$ of the internal resistor $R_X$ and the end voltage $V_c$ of the reference resistor $R_{IN}$, for example. Then, the comparator 110 may adjust the resistance value of the reference resistor $R_{IN}$ or adjust the current value of the variable current to change the end voltage $V_c$ based on the result of comparison. In the second stage, the switch 131 is not turned on, and the switch 133 is turned on. The setting unit 120 generates the setting current $I_{RT}$ based on the compensation current $I_{OFS1}/X$ and the current flowing through the external setting impedor $XR_T$, for example. In this way, the parameter setting circuit 100 is capable of generating the setting current $I_{RT}$ proportional to the voltage $V_{IN}$ and the external setting impedor $XR_T$ by being coupled to one single pin and the external setting impedor $XR_T$.

In the following, different exemplary embodiments where the comparator adjusts the end voltage $V_c$ of the reference resistor $R_{IN}$ based on the comparison result and the comparator adjusts the current value of the variable current based on the comparison result are respectively described in detail.

Figure 2:
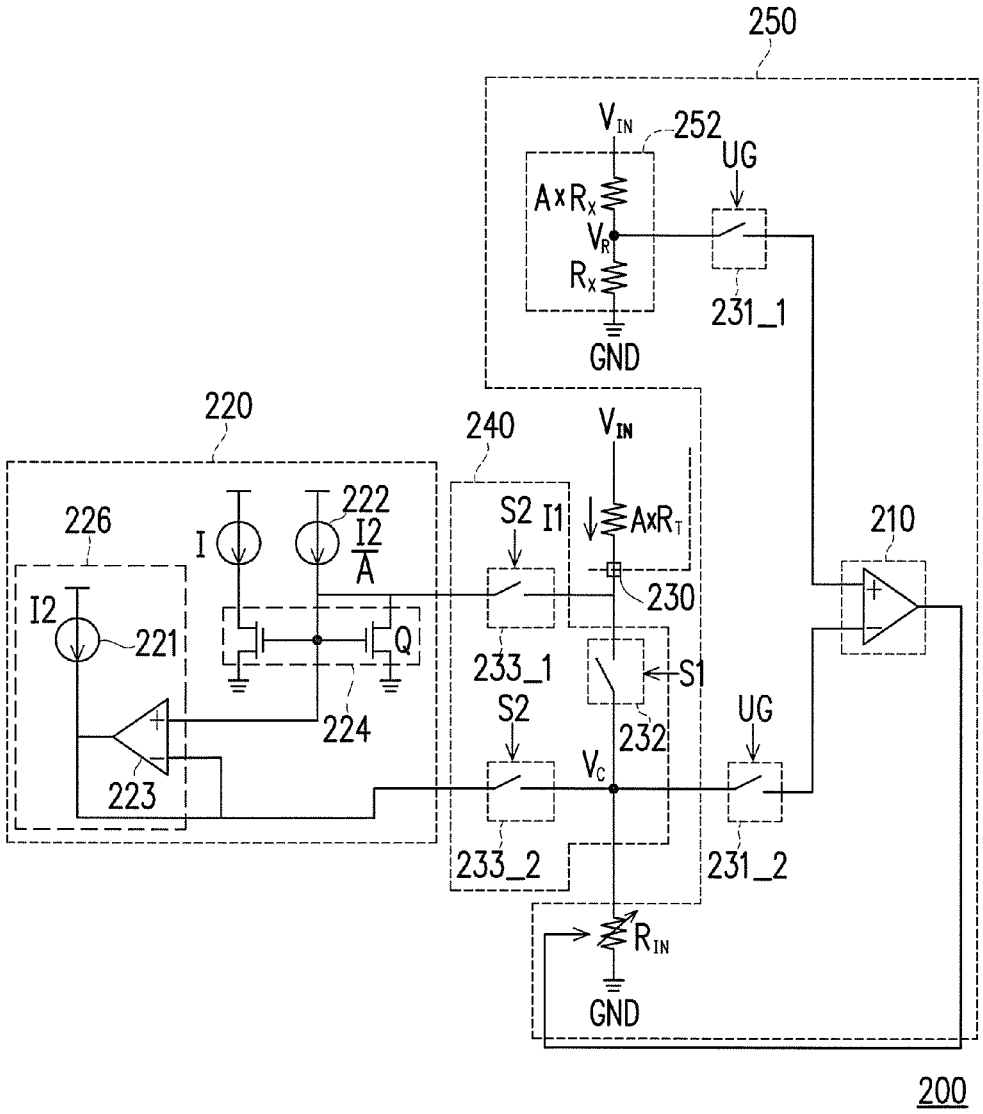
FIG. 2 is a schematic circuit view illustrating a parameter setting circuit according to an embodiment of the invention.
Figure 3:
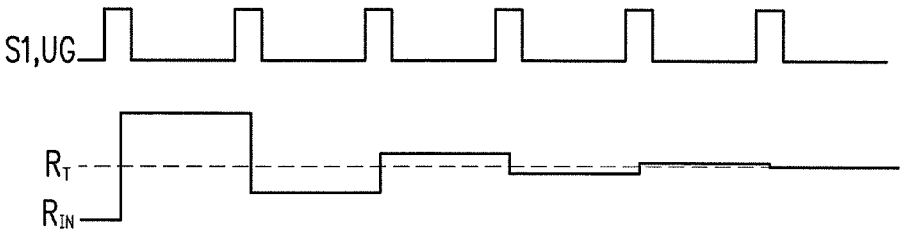
FIG. 3 is a schematic waveform diagram illustrating a control signal of the parameter setting circuit in the embodiment of FIG. 2 and the resistance value of a variable resistor thereof.

FIG. 2 is a schematic circuit view illustrating a parameter setting circuit according to an embodiment of the invention. FIG. 3 is a schematic waveform diagram illustrating a control signal of the parameter setting circuit in the embodiment of FIG. 2 and the resistance value of a resistor thereof. Referring to FIGS. 2 and 3, a parameter setting circuit 200 of this embodiment changes the end voltage $V_c$ by adjusting the resistance value of a variable resistor $R_{IN}$, for example. In this embodiment, the parameter setting circuit 200 includes a switch unit 240, an internal parameter adjustment unit 250, and a setting unit 220. In this embodiment, the setting reference unit may be the variable resistor $R_{IN}$, for example, an external setting impedor $A \times R_T$ and the variable resistor $R_{IN}$ form a resistor string. Here, A is a predetermined parameter ratio based on the practical design requirement. The invention does not intend to impose a limitation in this regard. In this embodiment, the predetermined parameter ratio A is a predetermined resistance ratio, for example. One end of the resistor string is coupled to the first voltage $V_{IN}$, and the other end is coupled to a second voltage GND. The first resistor $A \times R_X$ and the second resistor $R_X$ form a voltage dividing circuit 252 to provide the predetermined parameter ratio A. One end of the voltage dividing circuit 252 is coupled to the first voltage $V_{IN}$, and the other end is coupled to the second voltage GND.

Specifically, in this embodiment, an end of the second resistor $R_X$ coupled to the first resistor $A \times R_X$ is coupled to the comparator 210 through a first switch 231_1. The variable resistor $R_{IN}$ is coupled to the external setting impedor $A \times R_T$ through a second switch 232, and an end of the variable resistor $R_{IN}$ coupled to the external setting impedor $A \times R_T$ is coupled to the comparator 210 through a first switch 231_2. In other words, the respective ends of the second resistor $R_X$ and the variable resistor $R_{IN}$ are respectively coupled to the comparator 210 through the first switch. The control signals UG and S1 are respectively used to control turn-on/off states of the first switches 231_1 and 231_2 and the second switch 232. The waveforms thereof are shown in FIG. 3. In this embodiment, the control signals UG and S1 have the same phase, and simultaneously turn on/off the first switches 231_1 and 231_2 and the second switch 232. Thus, when the parameter setting circuit 200 is operated at the first stage, i.e., when the first switches 231_1 and 231_2 and the second switch 232 are turned on, the comparator 210 compares the reference voltage $V_R$ of the second resistor $R_X$ and the end voltage $V_c$ of the variable resistor $R_{IN}$, and adjusts the resistance value of the variable resistor $R_{IN}$ based on the comparison result, so as to change the end voltage $V_c$.

In this embodiment, the control signals UG and S1 respectively and periodically turn on/off the first switches 231_1 and 231_2 and the second switch 232. Thus, the comparator 210 periodically and repetitively compares the reference voltage $V_R$ of the second resistor $R_X$ and the end voltage $V_c$ of the variable resistor $R_{IN}$, and adjusts the resistance value of the variable resistor $R_{IN}$ based on the comparison result, so as to adjust the resistance value of the variable resistor $R_{IN}$ to be in a predetermined proportional relation with the resistance value of the external setting impedor $A \times R_T$. For example, a ratio between the variable resistor $R_{IN}$ and the external setting impedor $A \times R$ is the predetermined parameter ratio A. For example, the predetermined parameter ratios A of the first resistor $A \times R_X$ and the external setting impedor $A \times R_T$ are set to be equal. In addition, after the first stage is repetitively performed one or more times, the comparator 210 may adjust the resistance value of the variable resistor $R_{IN}$, for example, so as to change the end voltage $V_c$ to make the voltage values of two input ends of the comparator 210 equal. When such comparison result is established, the resistance value of the external setting impedor $A \times R_T$ and the resistance value of the variable resistor $R_{IN}$ have the predetermined proportional relation. For example, the ratio therebetween is the predetermined parameter ratio A, i.e., $$\frac{A \times R_T}{R_{IN}} = A,$$

and an equation of resistance values $R_{IN}=R_T$ is obtained, as shown in FIG. 3. $R_{IN}$ is the resistance value of the variable resistor, $A \times R_T$ is the resistance value of the external setting impedor, and A is the predetermined parameter ratio.

Also, in this embodiment, the setting unit 220 is coupled to the comparator 210 through third switches 233_1 and 233_2, for example. The control signal S2 is used to control turn-on/off states of the third switches 233_1 and 233_2, and the signal waveform of the control signal S2 is in an opposite phase of those of the control signals UG and S1. In other words, in this embodiment, when the first switches 231_1 and 231_2 and the second switch 232 are turned on, the third switches 233_1 and 233_2 are not turned on. On the contrary, when the first switches 231_1 and 231_2 and the second switch 232 are not turned on, the third switches 233_1 and 233_2 are turned on. In this embodiment, the control signal S2 is obtained by inverting the control signals UG and S1. However, the invention does not intend to impose a limitation in this regard. In this embodiment, the control signal S2 periodically and simultaneously turns on/off the third switches 233_1 and 233_2, such that when the parameter setting circuit 200 is operated at the second stage, i.e., when the third switches 233_1 and 233_2 are turned on, the setting unit 220 generates a setting current I at least based on a compensation current I2/A.

More specifically, in this embodiment, the setting unit 220 includes a compensation current source 222, a current mirror circuit 224, and a buffer circuit 226. A first end of the current mirror circuit 224 is coupled to the compensation current source 222 and the external setting impedor $A \times R_T$. The compensation current source 222 is configured to provide the compensation current I2/A to the current mirror circuit 224. When the third switch 233_1 is turned on, the external setting impedor $A \times R_T$ outputs a first current I1 to the current mirror circuit 224. For example, when the third switch 233_1 is turned on, a current value of the first current I1 is obtained by subtracting an end voltage Vth of the variable resistor $R_{IN}$ from the first voltage $V_{IN}$ and dividing the value after subtraction with the resistance value of the external setting impedor $A \times R_T$. Namely, the current value is $$I1 = \frac{V_{IN} - V_{th}}{A \times R_T},$$

wherein $V_{IN}$ is the voltage value of the first voltage, Vth is the voltage value of the end voltage of the variable resistor $R_{IN}$, and $A \times R_T$ is the resistance value of the external setting impedor. Then, the current mirror circuit 224 is configured to mirror the compensation current I2/A and the first current I1 from a first end of the current mirror circuit 224 to a second end of the current mirror circuit 224, so as to generate the setting current I. Here, A may be a predetermined parameter ratio based on the practical design requirement. However, the invention does not intend to impose a limitation in this regard.

In this embodiment, the buffer circuit 226 is coupled to the current mirror circuit 224 and the variable resistor $R_{IN}$. The buffer circuit 226 includes a compensation current source 221 and a buffer amplifier 223. An output end of the buffer amplifier 223 is coupled to the compensation current source 221, and two input ends of the buffer amplifier 223 are respectively coupled to the current mirror circuit 224 and the variable resistor $R_{IN}$. When the third switch 233_1 is turned on, the compensation current source 221 is configured to provide a second current I2 to the variable resistor $R_{IN}$. Thus, in this embodiment, the current value of the second current I2 is determined based on the resistance value of the variable resistor $R_{IN}$. Also, the current value of the compensation current I2/A is determined based on the current value of the second current I2. For example, when the third switch 233_1 is turned on, the current value of the second current I2 may be obtained by dividing the end voltage Vth of the variable resistor $R_{IN}$ with the resistance value of the variable resistor $R_{IN}$, for example. Namely, the current value I2 is equal to Vth/$R_{IN}$. Thus, the current value of the compensation current I2/A is $$\frac{I2}{A} = \frac{V_{IN}}{A \times R_{IN}},$$

wherein I2/A is the current value of the compensation current, Vth is the voltage value of the end voltage of the variable resistor $R_{IN}$, and $R_{IN}$ is the resistance value of the variable resistor. Accordingly, the current mirror circuit 224 mirrors the compensation current I2/A and the first current I1 from the first end of the current mirror circuit 224 to the second end of the current mirror circuit 224, and the current value of the setting current I generated by the current mirror circuit 224 is a sum of the compensation current I2/A and the first current I1, namely the current value is $$I = \frac{V_{IN} - V_{th}}{A \times R_T} + \frac{V_{th}}{A \times R_{IN}},$$

wherein I is the current value of the setting current, $V_{IN}$ is the voltage value of the first voltage, Vth is the voltage value of the end voltage of the variable resistor $R_{IN}$, $A \times R_T$ is the resistance value of the external setting impedor, and $R_{IN}$ is the resistance value of the variable resistor.

Thus, in this embodiment, the first stage and the second stage of the parameter setting circuit 200 are performed alternately and performed one or more times repetitively and periodically. In the first stage, the comparator 210 adjusts the resistance value of the variable resistor $R_{IN}$ to be in a predetermined proportional relation with the resistance value of the external setting impedor $A \times R_T$, such that an equation of resistance values $R_{IN}=R_T$ is established, as shown in FIG. 3. In the second stage, the setting current I generated by the setting unit 220 based on the compensation current I2/A and the first current I1 has the current value $$I = \frac{V_{IN} - V_{th}}{A \times R_T} + \frac{V_{th}}{A \times R_{IN}},$$

wherein I is the current value of the setting current, $V_{IN}$ is the voltage value of the first voltage, Vth is the voltage value of the end voltage of the variable resistor $R_{IN}$, $A \times R_T$ is the resistance value of the external setting impedor, and $R_{IN}$ is the resistance value of the variable resistor. When the equation of resistance values $R_{IN}=R_T$ is satisfied, the current value is $$I = \frac{V_{IN}}{A \times R_T}.$$

Thus, in this embodiment, the parameter setting circuit 200 is capable of generating the setting current I proportional to the voltage $V_{IN}$ and the external setting impedor $A \times R_T$ by being coupled to the external setting impedor $A \times R_T$ through one single pin 230. Here, A may be a predetermined parameter ratio based on the practical design requirement. However, the invention does not intend to impose a limitation in this regard.

In an embodiment, the parameter setting circuit 200 serves as a parameter setting circuit of a power conversion apparatus, for example. The internal parameter adjustment unit 250 has the predetermined parameter ratio A and a setting reference unit. In this embodiment, the predetermined parameter ratio A is implemented by using the reference voltage $V_R$ provided by the voltage dividing circuit 252. The setting reference unit may be the variable resistor $R_{IN}$, and a first end of the variable resistor $R_{IN}$ has the end voltage $V_c$. The internal parameter adjustment unit 250 adjusts the setting reference unit (i.e., the variable resistor $R_{IN}$) based on the operation of the switch unit 240, the external setting impedor $A \times R_T$, the first voltage $V_{IN}$, and the predetermined parameter ratio A. For example, the comparator 210 of the internal parameter adjustment unit 250 is configured to compare the reference voltage $V_R$ and the end voltage $V_c$, output the comparison result, and adjust the variable resistor $R_{IN}$ based on the comparison result. In this embodiment, the setting unit 220 is configured to provide the setting parameter to the power conversion apparatus based on the adjusted setting reference unit (i.e., the variable resistor $R_{IN}$). The setting parameter includes the setting current, for example.

Figure 4:
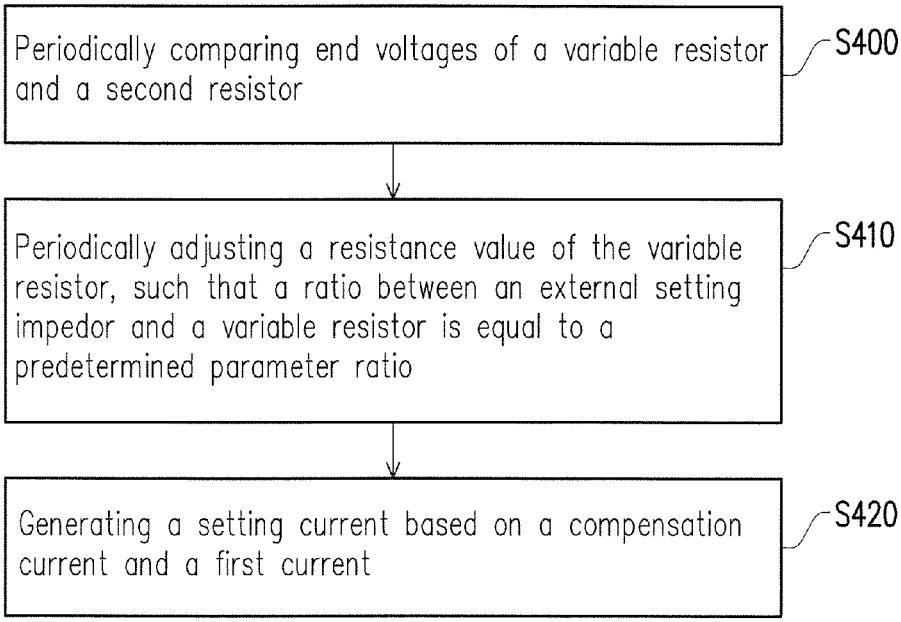
FIG. 4 is a flowchart illustrating a method for generating a current according to an embodiment of the invention.

FIG. 4 is a flowchart illustrating a method for generating a current according to an embodiment of the invention. Referring to FIGS. 2 to 4, the method for generating a current of this embodiment is at least adapted for the parameter setting circuit 200 shown in FIG. 2. In this embodiment, at Step S400, the comparator 210 periodically compares the end voltages of the variable resistor $R_{IN}$ and the second resistor $R_X$, namely the end voltage $V_c$ and the reference voltage $V_R$ based on the control signal UG. Then, at Step S410, the comparator 210 periodically adjusts the resistance value of the variable resistor $R_{IN}$ based on the control signal UG, such that the resistance values of the variable resistor $R_{IN}$ and the external setting impedor $A \times R_T$ have the predetermined proportional relation. For example, the ratio between the variable resistor $R_{IN}$ and the external setting impedor $A \times R_T$ is equal to the predetermined parameter ratio A, such that the equation of resistances $R_{IN}=R_T$ is established. Afterwards, at Step S420, the setting unit 220 generates the setting current I based on the compensation current I2/A and the first current I1, and the current value of the current I is $$I = \frac{V_{IN}}{A \times R_T}.$$

Thus, in this embodiment, the setting current I proportional to the first voltage $V_{IN}$ and the external setting impedor $A \times R_T$ is generated by using the parameter setting circuit 200 coupled to the external setting impedor $A \times R_T$ through the single pin 230 in the method for generating a current. Here, A may be a predetermined parameter ratio based on the practical design requirement. However, the invention does not intend to impose a limitation in this regard.

Also, sufficient teaching, suggestions, and descriptions for embodiment of the method for generating a current according to an embodiment of the invention can be obtained from the embodiments shown in FIGS. 2 and 3. Thus, repeated details will not be described in the following.

Figure 5:
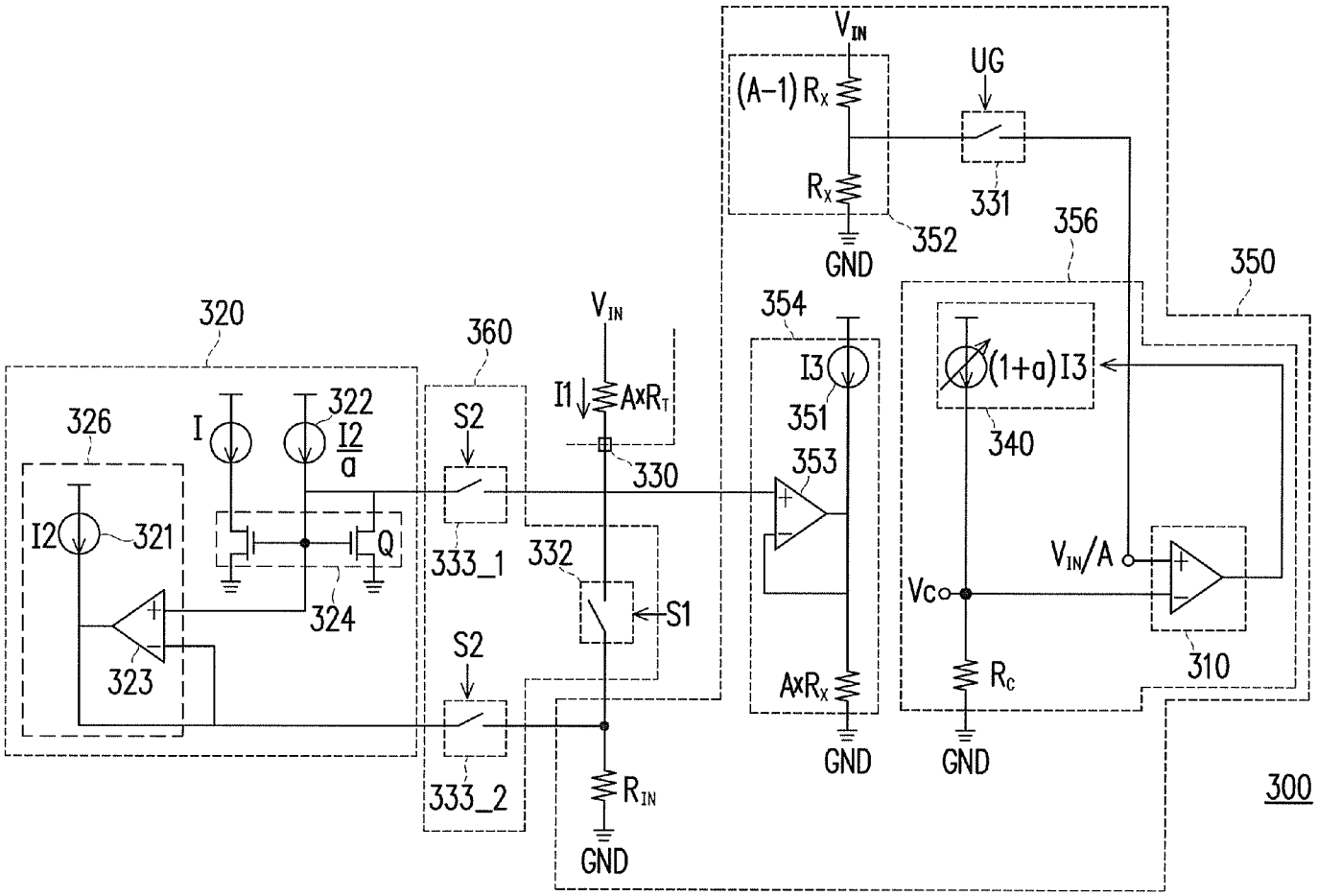
FIG. 5 is a schematic circuit view illustrating a parameter setting circuit according to another embodiment of the invention.
Figure 6:
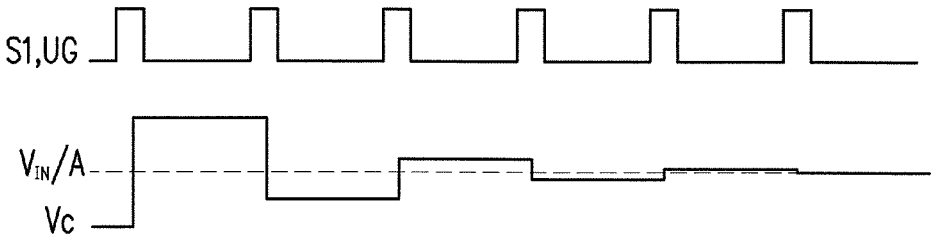
FIG. 6 is a schematic waveform diagram illustrating a control signal of the parameter setting circuit and an end voltage of an input end of a comparator in the embodiment of FIG. 5.

FIG. 5 is a schematic circuit view illustrating a parameter setting circuit according to another embodiment of the invention. FIG. 6 is a schematic waveform diagram illustrating a control signal of the parameter setting circuit and an end voltage of an input end of a comparator in the embodiment of FIG. 5. Referring to FIGS. 5 and 6, a parameter setting circuit 300 of this embodiment generates an output current by adjusting a variable current. In this embodiment, the parameter setting circuit 300 includes a switch unit 360, an internal parameter adjustment unit 350, and a setting unit 320. In this embodiment, the external setting impedor $A\times R_T$ and a fixed resistor $R_{IN}$ form a resistor string, and one end of the resistor string is coupled to the first voltage $V_{IN}$, while the other end of the resistor string is coupled to the second voltage GND. One end of a first resistor $(A-1)\times R_X$ is coupled to the second resistor $R_X$ to form a voltage dividing circuit 352. One end of the voltage dividing circuit 352 is coupled to the first voltage $V_{IN}$, and the other end of the voltage dividing circuit 352 is coupled to the second voltage GND. After voltage division, the voltage value at one end of the second resistor $R_X$ is a reference voltage $V_{IN}/A$. Also, in this embodiment, the internal parameter adjustment unit 350 includes a setting reference unit 356 and a first current generating circuit 354. The setting reference unit 356 includes a comparator 310, a second current generating circuit 340, and a reference resistor $R_C$. One end of the second current generating circuit 340 is coupled to the reference resistor $R_C$. The second current generating circuit 230 provides a variable current (1+a)I3 to the reference resistor $R_C$, so as to generate the end voltage $V_c$ at one end of the reference resistor $R_C$. Preferably, the value of the reference resistor $R_C$ is equal to the value of the second resistor $R_X$.

Specifically, in this embodiment, one end of the second resistor $R_X$ coupled to the first resistor $(A-1)\ R_X$ is coupled to the comparator 310 through a first switch 331 and provides the reference voltage $V_{IN}/A$. The reference resistor $R_C$ is coupled to the comparator 310. The fixed resistor $R_{IN}$ is coupled to the external setting impedor $A\times R_T$ through the second switch 332. The control signals UG and S1 are respectively used to control turn-on/off states the first switch 331 and the second switch 332. The waveforms thereof are shown in FIG. 6. In this embodiment, the control signals UG and S1 have the same phase, and simultaneously turn on/off the first switch 331 and the second switch 332. Thus, when the parameter setting circuit 300 is operated at the first stage, i.e., when the first switch 331 and the second switch 332 are turned on, the comparator 310 compares the reference voltage $V_{IN}/A$ of the second resistor $R_X$ and the end voltage $V_c$ of the reference resistor $R_C$. Here, A may be a predetermined parameter ratio based on the practical design requirement. However, the invention does not intend to impose a limitation in this regard. Then, the comparator 310 adjusts the current value of the variable current (1+a)I3, such as adjusting a setting parameter a, based on a comparison result, so as to change the end voltage $V_c$ of the reference resistor $R_C$. In this embodiment, the control signals UG and S1 respectively and periodically turn on/off the first switch 331 and the second switch 332. Thus, the comparator 310 periodically and repetitively compares the reference voltage $V_{IN}/A$ of the second resistor $R_X$ and the end voltage $V_c$ of the reference resistor $R_C$ and adjusts the current value of the variable current (1+a)I3 based on the comparison result, such that the reference voltage $V_{IN}/A$ of the second resistor $R_X$ and the end voltage $V_c$ of the reference resistor $R_C$ are substantially equal to each other. The signal waveforms thereof are shown in FIG. 6.

In this embodiment, the first current generating circuit 354 includes a current source 351, a buffer amplifier 353, and a fourth resistor $A\times R_X$. The current source 351 is configured to provide the first current I3 to the fourth resistor $A\times R_X$. An output end of the buffer amplifier 353 is coupled to the current source 351, and two input ends of the buffer amplifier 323 are respectively coupled to the fourth resistor $A\times R_X$ and the fixed resistor $R_{IN}$. When the second switch 332 is turned on, end voltages of the two input ends of the buffer amplifier 323 are equal to each other and substantially equal to an end voltage of one end that the external setting impedor $A\times R_T$ is coupled to the fixed resistor $R_{IN}$. Thus, the current value of the first current I3 flowing through the fourth resistor $A\times R_X$ is determined based on the resistance value of the fourth resistor $A\times R_X$ and an end voltage of one end that the fourth resistor $A\times R_X$ is coupled to an inverted input end of the buffer amplifier 323. After the current value of the first current I3 is determined, the current value of the variable current (1+a)I3 may also be determined based on the current value of the first current I3, so as to determine the end voltage $V_c$ of the reference resistor $R_C$. Thus, after the first stage is repetitively performed one or more times, the comparator 310 may adjust the current value of the variable current (1+a)I3 to make voltage values of two input ends of the comparator 310 equal. Namely, the reference voltage $V_{IN}/A$ of the second resistor $R_X$ and the end voltage $V_c$ of the reference resistor $R_C$ are equal, as shown in FIG. 6. When such comparison result is established, the resistance value of the fixed resistor $R_{IN}$ and the resistance value of the external setting impedor $A\times R_T$ have a predetermined proportional relation. For example, a ratio between the resistance value of the fixed resistor $R_{IN}$ and the resistance value of the external setting impedor $A\times R_T$ is 1/a, namely $$\frac{R_{IN}}{A\times R_T}=\frac{1}{a}.$$

Thus, an equation of resistance values $a\times R_{IN}=A\times R_T$ may be established, wherein RIN is the resistance value of the fixed resistor, and $A\times R_T$ is the resistance value of the external setting impedor.

In this embodiment, the end voltages of the two input ends of the amplifier buffer 323 are equal, and are substantially equal to the end voltage of the end that the fixed resistor $R_{IN}$ is coupled to the external setting impedor $A\times R_T$. The current value of the first current I3 is determined based on the resistance value of the fourth resistor $A\times R_X$ and the end voltage of the end that the fourth resistor $A\times R_X$ is coupled to the inverted input end of the buffer amplifier 323. In addition, the current value of the variable current (1+a)I3 is determined based on the current value of the first current I3, so as to determine the end voltage $V_c$ of the reference resistor $R_C$.

Also, in this embodiment, the setting unit 320 is coupled to the comparator 310 through third switches 333_1 and 333_2, for example. The control signal S2 is used to control turn-on/off states of the third switches 333_1 and 333_2, and the signal waveform of the control signal S2 is in an opposite phase of those of the control signals UG and S1. In other words, in this embodiment, when the first switches 331_1 and 331_2 and the second switch 332 are turned on, the third switches 333_1 and 333_2 are not turned on. On the contrary, when the first switches 331_1 and 331_2 and the second switch 332 are not turned on, the third switches 333_1 and 333_2 are turned on. In this embodiment, the control signal S2 is obtained by inverting the control signals UG and S1. However, the invention does not intend to impose a limitation in this regard. In this embodiment, the control signal S2 periodically and simultaneously turns on/off the third switches 333_1 and 333_2, such that when the parameter setting circuit 300 is operated at the second stage, i.e., when the third switches 333_1 and 333_2 are turned on, the setting unit 320 generates the setting current I at least based on a compensation current I2/a.

More specifically, in this embodiment, the setting unit 320 includes a compensation current source 322, a current mirror circuit 324, and a buffer circuit 326. A first end of the current mirror circuit 324 is coupled to the compensation current source 322 and the external setting impedor $A\times R_T$. The compensation current source 322 is configured to provide the compensation current I2/a to the current mirror circuit 324. In this embodiment, the comparator 310 adjusts the current value of the variable current (1+a)I3, such as adjusting a parameter value a, based on the comparison result. Thus, the current value of the compensation current I2/a is changed based on the current value of the variable current (1+a)I3. When the third switch 333_1 is turned on, the external setting impedor $A\times R_T$ outputs the third current I1 to the current mirror circuit 324. For example, when the third switch 333_1 is turned on, the current value of the third current I1 is obtained by subtracting the end voltage Vth of $R_{IN}$ from the first voltage $V_{IN}$ and dividing the value after subtraction with the resistance value of the external setting impedor $A\times R_T$. Namely, the current value is $$I1 = \frac{V_{IN} - V_{th}}{A \times R_T},$$

wherein $V_{IN}$ is the voltage value of the first voltage, Vth is the voltage value of the end voltage of the reference resistor $R_{IN}$, and $A\times R_T$ is the resistance value of the external setting impedor. A may be a predetermined parameter ratio based on the practical design requirement, and the invention does not intend to impose a limitation in this regard. Then, the current mirror circuit 324 is configured to mirror the compensation current I2/a and the third current I1 from a first end of the current mirror circuit 324 to a second end of the current mirror circuit 324, so as to generate the setting current I.

In this embodiment, the buffer circuit 326 is coupled to the current mirror circuit 324 and the fixed resistor $R_{IN}$. The buffer circuit 326 includes a compensation current source 321 and a buffer amplifier 323. An output end of the buffer amplifier 323 is coupled to the compensation current source 321, and the two input ends of the buffer amplifier 323 are respectively coupled to the current mirror circuit 324 and the variable resistor $R_{IN}$. When the third switch 333_2 is turned on, the compensation current source 321 is configured to provide the second current I2 to the fixed resistor $R_{IN}$. Thus, in this embodiment, the current value of the second current I2 is determined based on the resistance value of the fixed resistor $R_{IN}$. Also, the current value of the compensation current I2/a is determined based on the current value of the second current I2. For example, when the third switch 333_2 is turned on, the current value of the second current I2 may be obtained by dividing the end voltage Vth of the reference resistor $R_{IN}$ of a transistor Q with the resistance value of the fixed resistor $R_{IN}$, for example. Namely, the current value I2 is equal to Vth/$R_{IN}$. Thus, the current value of the compensation current I2/a is $$\frac{I2}{a} = \frac{V_{th}}{a \times R_{IN}},$$

wherein I2/a is the current value of the compensation current, Vth is the voltage value of the end voltage of the reference resistor $R_{IN}$, and $R_{IN}$ is the resistance value of the fixed resistor. Accordingly, the current mirror circuit 324 mirrors the compensation current I2/a and the third current I1 from the first end of the current mirror circuit 324 to the second end of the current mirror circuit 324, and the current value of the setting current I generated by the current mirror circuit 324 is a sum of the compensation current I2/a and the third current I1, namely the current value is $$I = \frac{V_{IN} - V_{th}}{A \times R_T} + \frac{V_{th}}{a \times R_{IN}},$$

wherein I is the current value of the setting current, $V_{IN}$ is the voltage value of the first voltage, Vth is the voltage value of the end voltage of the reference resistor $R_{IN}$, $A\times R_T$ is the resistance value of the external setting impedor, and $R_{IN}$ is the resistance value of the fixed resistor.

Thus, in this embodiment, the first stage and the second stage of the parameter setting circuit 300 are performed alternately and performed one or more times repetitively and periodically. In the first stage, the comparator 310 adjusts the current value of the variable current (1+a)I3 based on the comparison result, such that the reference voltage $V_{IN}$/A of the second resistor $R_X$ and the end voltage $V_c$ of the reference resistor $R_C$ are substantially equal. The waveforms thereof are as shown in FIG. 6. In this way, the equation of resistance values $a\times R_{IN}=A\times R_T$ is established. In the second stage, the setting unit 320 generates the setting current I based on the compensation current I2/a and the third current I1, and the current value of the current I is $$I = \frac{V_{IN} - V_{th}}{A \times R_T} + \frac{V_{th}}{a \times R_{IN}}.$$

When the equation of resistance values $a\times R_{IN}$ $A\times R_T$ is established, the current value is $$I = \frac{V_{IN}}{A \times R_T}.$$

Thus, in this embodiment, the parameter setting circuit 300 is capable of generating the setting current I proportional to the first voltage $V_{IN}$ and the external setting impedor $A\times R_T$ by being coupled to the external setting impedor $A\times R_T$ through one single pin 330. Here, A may be a predetermined parameter ratio based on the practical design requirement. However, the invention does not intend to impose a limitation in this regard.

In an embodiment, the parameter setting circuit 300 serves as a parameter setting circuit of a power conversion apparatus, for example. The internal parameter adjustment unit 350 has the predetermined parameter ratio A and a setting reference unit 354. In this embodiment, the predetermined parameter ratio A is implemented by using the reference voltage $V_R$ provided by the voltage dividing circuit 352. The setting reference unit 354 includes a second current generating circuit 340 that provides a variable current. The internal parameter adjustment unit 350 adjusts the setting reference unit 354 (i.e., adjusting the variable current) based on the operation of the switch unit 340, the external setting impedor $A \times R_T$, the first voltage $V_{IN}$, and the predetermined parameter ratio A. For example, the comparator 310 of the internal parameter adjustment unit 350 is configured to compare the reference voltage $V_{IN}/A$ and the end voltage $V_c$, output the comparison result, and adjust the variable current based on the comparison result. In this embodiment, the setting unit 320 is configured as a setting unit providing the setting parameter to the power conversion apparatus based on the adjusted setting reference unit 354 (i.e., the variable current). The setting parameter includes the setting current, for example.

Figure 7:
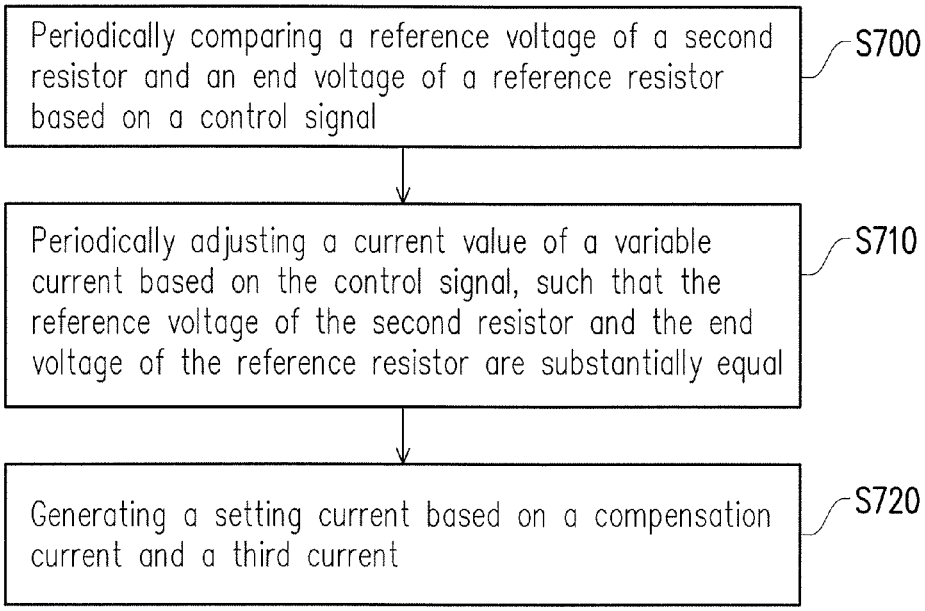
FIG. 7 is a flowchart illustrating a method for generating a current according to another embodiment of the invention.

FIG. 7 is a flowchart illustrating a method for generating a current according to another embodiment of the invention. Retelling to FIGS. 5 to 7, the method for generating a current of this embodiment is at least adapted for the parameter setting circuit 300 shown in FIG. 5. In this embodiment, at Step S700, the comparator 310 periodically compares the end voltages of the second resistor $R_X$ and the reference resistor $R_C$, namely the reference voltage $V_{IN}/A$ and the end voltage $V_c$ based on the control signal UG. Then, at Step S710, the comparator 310 periodically adjusts the current value of the variable current (1+a)I3 based on the control signal UG, such that the reference voltage $V_{IN}/A$ of the second resistor $R_X$ and the end voltage $V_c$ of the reference resistor $R_C$ are substantially equal. In this way, the equation of resistance values $a \times R_{IN} = A \times R_T$ is established. Afterwards, at Step S720, the setting unit 320 generates the setting current I based on the compensation current I2/a and the third current I1, and the current value of the current I is $$I = \frac{V_{IN}}{A \times R_T}.$$

Thus, in this embodiment, the setting current I proportional to the voltage $V_{IN}$ and the external setting impedor $A \times R_T$ is generated by using the parameter setting circuit 300 coupled to the external setting impedor $A \times R_T$ through the single pin 330 in the method for generating a current. Here, A may be a predetermined parameter ratio based on the practical design requirement. However, the invention does not intend to impose a limitation in this regard.

Also, sufficient teaching, suggestions, and descriptions for embodiment of the method for generating a current according to an embodiment of the invention can be obtained from the embodiments shown in FIGS. 5 and 6. Thus, repeated details will not be described in the following.

Figure 8:
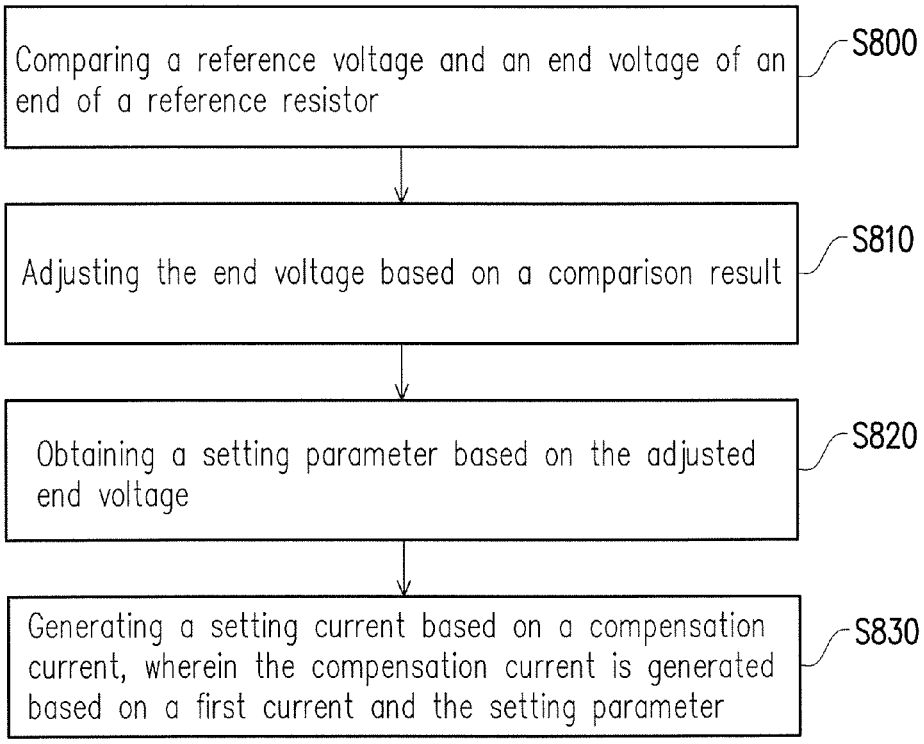
FIG. 8 is a flowchart illustrating a method for generating a current of the invention.

FIG. 8 is a flowchart illustrating a method for generating a current according to another embodiment of the invention. Referring to FIGS. 1A, 1B, 2, 5, and 8, the method for generating a current of this embodiment is at least adapted for the parameter setting circuit 400 shown in FIG. 1A, the parameter setting circuit 100 shown in FIG. 1B, the parameter setting circuit 200 shown in FIG. 2, and the parameter setting circuit 300 shown in FIG. 5. In this embodiment, at Step S800, a reference voltage and an end voltage of an end of a reference resistor are compared to obtain a comparison result. Then, at Step S810, the end voltage is adjusted based on the comparison result. At Step S820, a setting parameter is obtained based on the adjusted end voltage. Then, at Step S830, a setting current is generated based on a compensation current. The compensation current is generated based on a first current and the setting parameter.

Also, sufficient teaching, suggestions, and descriptions for embodiment of the method for generating a current according to an embodiment of the invention can be obtained from the embodiments shown in FIGS. 1A to 7. Thus, repeated details will not be described in the following.

In view of the foregoing, in the exemplary embodiment of the invention, the parameter setting circuit is coupled to the external voltage and the external setting impedor through the single pin. In the method for generating a current, the resistance value of the internal resistor is adjusted or the current value of the variable current is adjusted based on the comparison result of the end voltages of two internal resistors, so as to generate the setting current accurately proportional to the external voltage and the external setting impedor.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A parameter setting circuit, coupled to an external setting impedor, the circuit comprising:

a switch unit, coupled to the external setting impedor;

an internal parameter adjustment unit, coupled to the switch unit and comprising:

a setting reference unit, coupled to the external setting impedor through the switch unit, wherein the internal parameter adjustment unit provides an adjustment parameter through an operation of the switch unit based on a predetermined parameter ratio, the external setting impedor, and the setting reference unit; and a setting unit, coupled to the switch unit, wherein the setting unit generates a setting current based on the operation of the switch unit, the setting current is a combination of an adjustment current and an initial setting current, and the adjustment current is related to the adjustment parameter.

2. The parameter setting circuit as claimed in claim 1, further comprising:

a voltage dividing circuit, presenting the predetermined parameter ratio by using a reference voltage that is provided;

a comparator, wherein an input end of the comparator is coupled to the voltage dividing circuit and a first end of the setting reference unit, the comparator outputs a comparison result, and an end voltage of the first end is adjusted based on the comparison result.

3. The parameter setting circuit as claimed in claim 2, wherein a control signal periodically controls the switch unit, and the comparator periodically compares and adjusts the end voltage based on the comparison result.

4. The parameter setting circuit as claimed in claim 2, wherein the setting reference unit is a variable resistor, and the comparator controls a resistance value of the variable resistor based on the comparison result to change the end voltage.

5. The parameter setting circuit as claimed in claim 4, wherein when the end voltage is equal to the reference voltage, a ratio between the external setting impedor and the variable resistor is equal to the predetermined parameter ratio.

6. The parameter setting circuit as claimed in claim 2, wherein the internal parameter adjustment unit further comprises a variable current source providing a variable current and coupled to the setting reference unit to adjust the variable current based on the comparison result, so as to change the end voltage.

7. The parameter setting circuit as claimed in claim 6, wherein the compensation current is changed based on a current value of the variable current.

8. The parameter setting circuit as claimed in claim 2, wherein the external setting impedor is coupled to a first voltage to output a first current, and the current generating circuit further comprises:

a current mirror circuit, comprising a first end and a second end, wherein the first end is coupled to the compensation current source and the external setting impedor, and the current mirror circuit is configured to mirror the compensation current and the first current from the first end to the second end, so as to generate the setting current.

9. A parameter setting circuit for a power conversion apparatus, coupled to a first end of an external setting impedor, wherein a second end of the external setting impedor is coupled to a first voltage, and the parameter setting circuit comprises:

a switch unit, coupled to the external setting impedor;

an internal parameter adjustment unit, having a predetermined parameter ratio and a setting reference unit, wherein the setting reference unit is coupled to the switch unit, and the internal parameter adjustment unit adjusts the setting reference unit based on an operation of the switch unit, the external setting impedor, the setting reference unit, the first voltage, and the predetermined parameter ratio, and provides a setting parameter based on the adjusted setting reference unit; and a setting unit, coupled to the switch unit and generating a setting current based on the first voltage, the external setting impedor, and the setting parameter.

10. The parameter setting circuit as claimed in claim 9, wherein the setting reference unit is coupled to the external setting impedor through the switch unit, and a control signal periodically controls the switch unit to compare and adjust the setting reference unit.

11. The parameter setting circuit as claimed in claim 9, wherein the internal parameter adjustment unit comprises a voltage dividing circuit, the voltage dividing circuit provides a reference voltage to present the predetermined parameter ratio, the setting reference unit is a variable resistor having a first end that has an end voltage, and the internal parameter adjustment unit comprises a comparator configured to compare the reference voltage and the end voltage, output a comparison result, and adjust the variable resistor based on the comparison result.

12. The parameter setting circuit as claimed in claim 11, wherein when a ratio between the external setting impedor and the variable resistor is equal to the predetermined parameter ratio, the internal parameter adjustment unit provides the setting parameter based on the adjusted variable resistance.

13. The parameter setting circuit as claimed in claim 11, wherein the setting unit comprises:

a compensation current source, providing a compensation current based on the setting parameter.

14. The parameter setting circuit as claimed in claim 9, wherein the internal parameter adjustment unit comprises the setting reference unit and a first current generating circuit, and the first current generating circuit generates a first current based on the operation of the switch unit, the external setting impedor, the setting reference unit, and the first voltage.

15. The parameter setting circuit as claimed in claim 14, wherein the setting reference unit comprises a second current generating circuit and a comparator, the second current generating circuit is coupled to the comparator, and the comparator adjusts a compensation current source by using the first current, so as to provide the setting parameter.

16. The parameter setting circuit as claimed in claim 9, wherein the external setting impedor provides a first current, and the setting unit comprises:

a current mirror circuit, comprising a first end and a second end, wherein the first end is coupled to the compensation current source and the external setting impedor, and the current mirror circuit is configured to mirror the compensation current and the first current from the first end to the second end, so as to generate the setting current.

17. A method for generating a current, adapted for a parameter setting circuit coupled to an external setting impedor, wherein the external setting impedor is coupled to an external voltage to output a first current, the method comprising:

comparing a reference voltage and an end voltage of an end of a reference resistor to obtain a comparison result;

adjusting the end voltage based on the comparison result;

obtaining a setting parameter based on the adjusted end voltage; and generating a setting current based on a compensation current, wherein the compensation current is generated based on the first current and the setting parameter.

18. The method for generating the current as claimed in claim 17, wherein in the step of comparing the reference voltage and the end voltage of the end of the reference resistor, the reference voltage and the end voltage are compared periodically based on a control signal.

19. The method for generating the current as claimed in claim 17, wherein the step of adjusting the end voltage based on the comparison result comprises:

changing the end voltage by adjusting a resistance value of the reference resistor, such that the reference voltage and the end voltage are substantially equal.

20. The method for generating the current as claimed in claim 17, wherein the step of adjusting the end voltage based on the comparison result comprises:

changing the end voltage by adjusting a current value of a variable current coupled to the reference resistor, such that the reference voltage and the end voltage are substantially equal.

21. The method for generating the current as claimed in claim 17, wherein the step of generating the setting current based on the compensation current comprises:

mirroring the compensation current and the first current from a first end of a current mirror circuit to a second end of the current mirror circuit, so as to generate the setting current, wherein a current value of the compensation current is determined based on a current value of a second current, and the current value of the second current is determined by the setting parameter.

* * * * *